United States Patent [19]

Servadio

[11] Patent Number: 4,660,827

[45] **Date of Patent: * Apr. 28, 1987**

[54] PUNCHING BAG REBOUND ADJUSTER

[76] Inventor: Robert Servadio, Pittsburgh, Pa.

[ * ] Notice: The portion of the term of this patent subsequent to Apr. 23, 2002 has been disclaimed.

[21] Appl. No.: 819,997

[22] Filed: Jan. 21, 1986

[51] Int. Cl.[4] ..... A63B 69/22

[52] U.S. Cl. ..... 272/78

[58] Field of Search ..... 272/76–78, 272/102, 109, 63, 103; 273/1.5 R, 29 BB, 29 BC; 49/29; 128/71; 272/103

[56] References Cited

U.S. PATENT DOCUMENTS

| | | | |
|---|---|---|---|
| 717,273 | 12/1902 | Reach | 272/78 |
| 1,737,108 | 11/1929 | Craig | 272/103 |
| 1,998,454 | 4/1935 | Gordon | 49/29 |
| 2,961,236 | 11/1960 | Murphy | 273/1.5 R |
| 4,230,098 | 10/1980 | Uematsu | 128/71 |
| 4,491,314 | 1/1985 | Belyavsky et al. | 272/63 |
| 4,512,568 | 4/1985 | Servadio | 272/78 |

FOREIGN PATENT DOCUMENTS 2708130 2/1977 Fed. Rep. of Germany .

*Primary Examiner*—Richard J. Apley
*Assistant Examiner*—S. R. Crow
*Attorney, Agent, or Firm*—William J. Ruano

[57] ABSTRACT

An electrically operated rebound adjuster for a punching bag, comprising a reversible electric drive motor which rotates a vertically mounted screw-threaded spindle or shaft on the lower end of which a punching bag is supported so as to selectively raise or lower the position of the punching bag relative to a horizontal rebound board. Limit controls prevent excessive travel of the shaft in either direction to prevent excessive raising or lowering of the punching bag relative to the rebound board. The rebound board supports the entire control assembly through supporting brackets. No control panel or complicated drive mechanism is required.

1 Claim, 2 Drawing Figures

PUNCHING BAG REBOUND ADJUSTER

This invention relates to a punching bag rebound adjuster and is an improvement over that covered by my U.S. Pat. No. 4,512,568, issued Apr. 23, 1985.

An outstanding disadvantage of supporting mechanisms for punchings bags has been that no suitable vernier adjustments were made possible, or adjustments that were truly maintenance-free as well as easy and speedy to make. A disadvantage of my above-mentioned patented adjuster is that the gearing mechanism driving the spindle was too complicated and expensive.

An object of this invention is to provide a novel rebound adjuster for a punching bag which is exceedingly simple and instantaneous to operate, either upwardly or downwardly to shorten or lengthen the swing of the bag and which prevents abnormal adjustments, either in the vertically upward or downward direction.

Another object of the invention is to provide a rigid and practically indestructible mechanism for selectively adjusting a punching bag either upwardly or downwardly of a rebound board within predetermined limits and which has simple, standard parts and is inexpensive to manufacture and has relatively long life.

Figure 2:
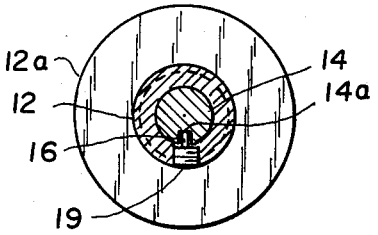
Figure 1:
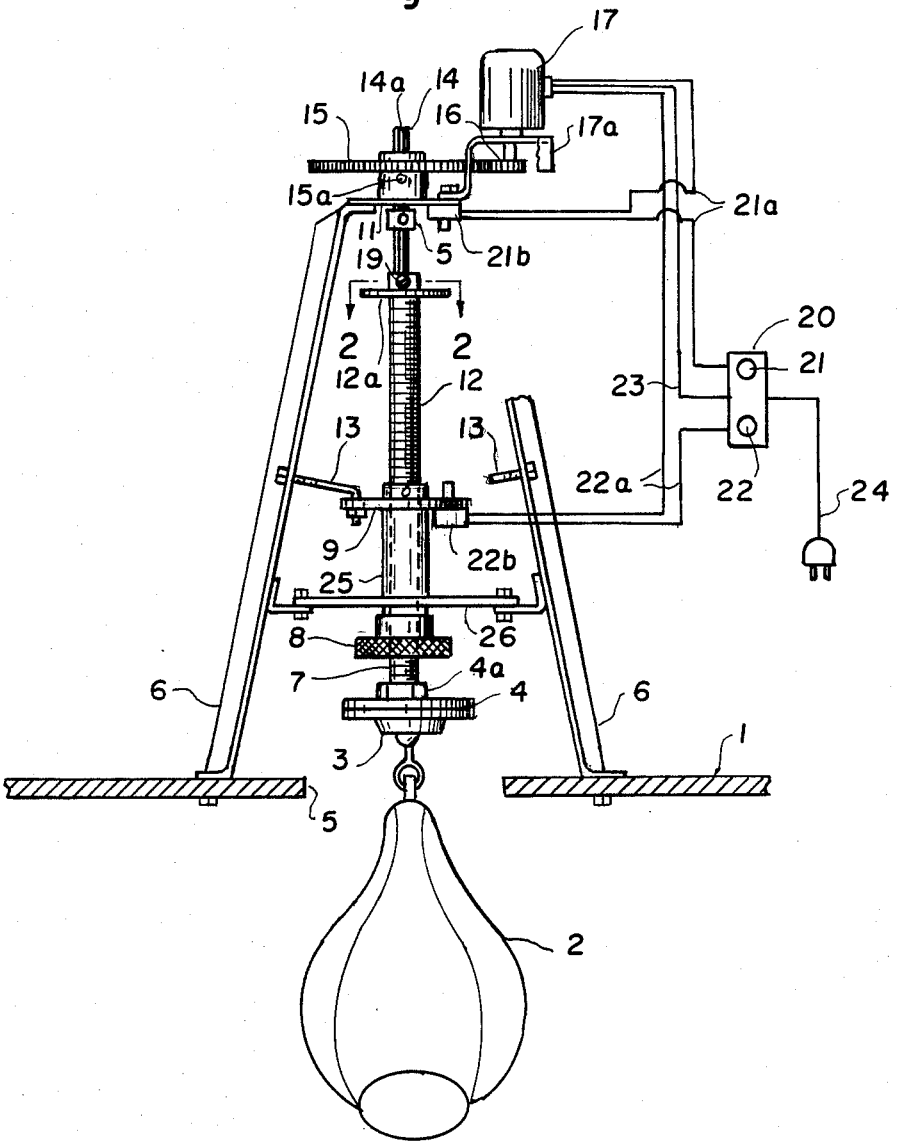

Other objects and advantages of the invention will become more apparent from a study of the following description, taken with the accompanying drawing wherein:

FIG. 1 is an elevational view of a punching bag rebound adjuster embodying the principles of the present invention; and FIG. 2 is an enlarged cross-sectional view taken along line 2—2 of FIG. 1.

Referring more particularly to the drawing, numeral 1 denotes a rebound board for a punching bag 2 which is supported by a hook or eye from a swivel 3, swivel mounting plate 4 and locking nut 4*a* to enable the punching bag to be secured permanently to threaded elevator shaft 7 and then locked in place by nut 4*a* in the space 5 cut out of the center of a rebound board 1.

Three mounting legs 6, rigidly fastened to the rebound board 1 serve as supports for shaft 7, its driving motor 17 and gear train.

A reversible drive motor 17 is energized by plugging plug 24 into an A. C. outlet and controlling the drive by up and down switches 21*b* and 22*b* in a switch box 20. Motor 17 drives a pinion 16 which drives a gear 15 which, in turn, is coupled to a collar and shaft 14 by set screw 15*a*.

A knurled locking nut 8, which serves to lock the height of bag 2 when desired bag height is reached, is internally threaded to shaft 7 and engages the lower end of stationary sleeve 25 rigidly mounted, by plates 26 and 9 and arms 13 to legs 6. Sleeve 25 is internally threaded to receive externally threaded shaft 12 which is vertically reciprocable on drive shaft 14.

As will appear in FIG. 2, shaft 14 has a longitudinal groove 14*a* throughout its length into which is projected set screw 19, the inner end 19*a* of which rides along and is guided by groove 14*a* so as to enable elevator shaft 12 to selectively move either upwardly or downwardly of shaft 14.

As in the circuit of my above previous patent, such upward or downward movement of elevator shaft 7 is limited by limit stop switches 21*b* and 22*b* which interrupt the circuit when switch 21*b* is opened by plate 12*a* as the elevator shaft 7 moves upwardly or by opening of switch 22*b* by plate 12*a* as the elevator shaft 7 moves downwardly to thereby limit the extent of travel of elevator shaft 7 and prevent over-run.

Thus it will be seen that I have provided a highly efficient and easily and quickly operated control mechanism for selectively raising or lowering a punching bag relative to a rebound board and which is capable of making vernier adjustments almost instantly by the mere pressing of a control button; furthermore, I have provided a highly efficient, electrically operated drive for moving an elevator shaft in opposite directions to selectively effect upward or downward movement of the punching bag, at will, and which is of very rigid and durable construction and practically maintenance-free.

While I have illustrated and described a single specific embodiment of my invention, it will be understood that this is by way of illustration only and that various changes and modifications may be contemplated in my invention within the scope of the following claims.

I claim:

1. In combination with a rebound board, having a central hole, and a punching bag, mounting means for suspending said punching bag from said rebound board through said central hole, including adjusting means comprising a vertically mounted elevator threaded shaft, from the lower end of which said punching bag is suspended coaxially with said shaft, a vertical stationarily mounted sleeve internally threaded to an outwardly threaded sleeve surrounding said shaft and which is keyed to said shaft, a knurled locking nut screwed to said threaded shaft and engageable with the bottom of said sleeve to adjustably limit the height of said bag, driving motor means for driving a pinion gear which directly drives a gear rigidly secured to the top end of said vertical shaft to effect selective lifting or lowering of said sleeve in response to rotation of said driving motor means in one direction or in an opposite direction to adjust the distance between the rebound board and punching bag, said mounting means including a vertical stationary frame which rigidly supports said vertical stationarily mounted sleeve and supports said driving motor means on top thereof, said driving motor means including an electrical control circuit, including a pair of vertically spaced switches directly mounted on said electrical control means including said frame, switch operating means mounted on said outwardly threaded sleeve for interrupting said circuit upon predetermined vertical upward and downward movement of said outwardly threaded sleeve.

* * * * *